United States Patent [19]

Morrison

[11] 4,191,360

[45] Mar. 4, 1980

[54] CONCRETE REINFORCEMENT MESH LIFTING TOOL

[76] Inventor: Donald R. Morrison, 2109 Camp Green St., Charlotte, N.C. 28208

[21] Appl. No.: 44,493

[22] Filed: Jun. 1, 1979

[51] Int. Cl.[2] ..... B25B 1/04

[52] U.S. Cl. ..... 254/129; 254/131

[58] Field of Search ..... 254/17, 21, 30, 44, 254/120, 121, 129–132

[56] References Cited

U.S. PATENT DOCUMENTS

| | | | |
|---|---|---|---|
| 1,819,445 | 8/1931 | Soeffken | 254/120 X |
| 1,844,809 | 2/1932 | Spaugh | 254/132 X |
| 2,547,474 | 4/1951 | La Munyon | 254/131 |
| 3,152,708 | 10/1964 | Agesen | 254/132 X |
| 3,254,876 | 6/1966 | Powell | 254/132 |

*Primary Examiner*—Robert C. Watson

*Attorney, Agent, or Firm*—B. B. Olive

[57] ABSTRACT

A tool for lifting concrete reinforcement wire mesh comprises a lever and support structure enabling the pivot point to be adjusted vertically as well as along the length of the lever.

1 Claim, 3 Drawing Figures

CONCRETE REINFORCEMENT MESH LIFTING TOOL

BACKGROUND OF THE INVENTION

1. Field of the Invention

This invention relates to tools and particularly to lever type tools.

2. Description of the Prior Art

Specifications for concrete work such as for concrete slabs, and the like, often require that the reinforcing wire mesh be at some predetermined distance with respect to the top surface of the slab. Thus, it often becomes necessary after the concrete mix has been poured to adjust the height of the mesh with respect to the top surface of the slab to meet the specifications. This lifting operation has often been done by hand, by use of wooden boards or sometimes by use of a tool shaped very much like an ordinary walking cane. Often the specifications for the concrete work also require that a plastic sheet be placed on the ground surface and in using such a lifting tool it is necessary to avoid puncturing this protective sheet. Considerable time has been lost in use of such cumbersome tools and often it is necessary to place a so-called chair, i.e., a support, at selected points under the reinforcement mesh or rebar mesh which is also used in concrete work.

Since the weight of the mesh and thickness of the slab will often vary from job to job, various temporary measures have been taken aimed at increasing the length of the lever or moving the pivot point of the lever device, whatever it is, to better handle the particular job in hand.

With the foregoing in mind, the object of the present invention is that of providing a substantially improved tool specifically designed for use in lifting reinforcement mesh wire, and the like, and handling other lifting jobs such as raising forms as are often encountered in concrete pouring operations.

SUMMARY OF THE INVENTION

The tool of the invention comprises an elongated lever with a specially shaped point at one end which is designed to engage strands of mesh wire, and the like, without puncturing underlying protective sheets, such as plastic sheets, or the like. The mentioned lever mounts on a pivotal support structure which is arranged to slide along the length of the lever and is also provided with a telescoping leg arrangement so that the pivot point can be adjusted both vertically and in a linear direction on the lever.

DESCRIPTION OF THE PREFERRED EMBODIMENT

Figure 1:
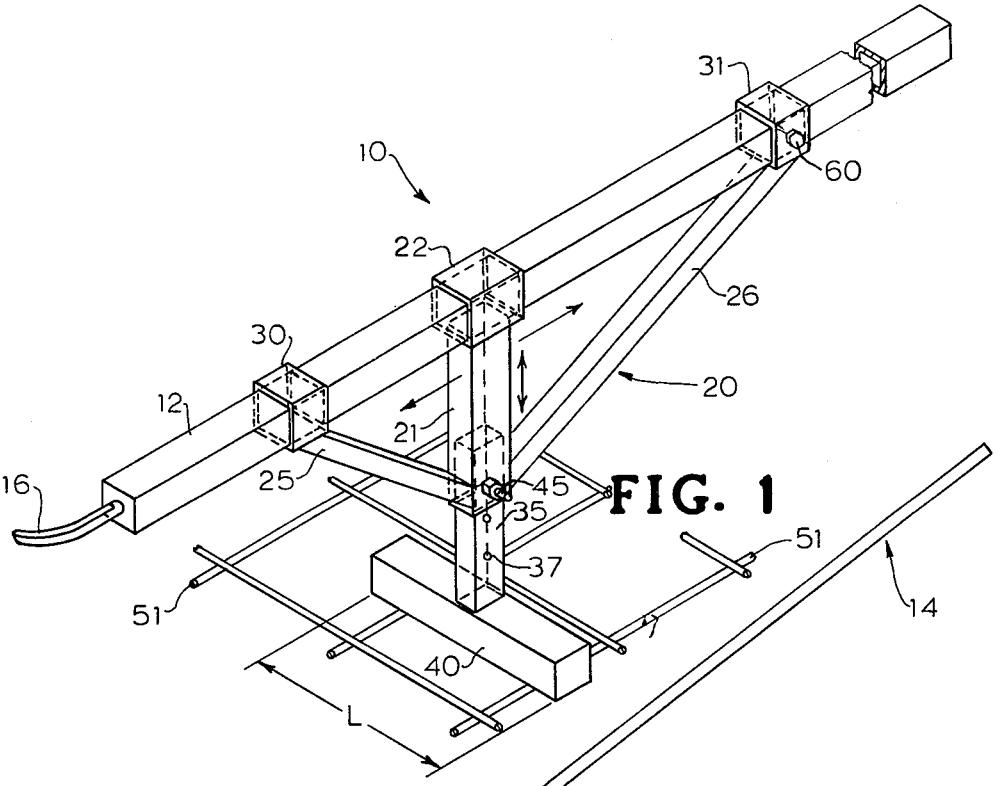
FIG. 1 is a perspective view of a tool according to the invention and is shown in place on a portion of concrete reinforcement mesh wire.
Figure 2:
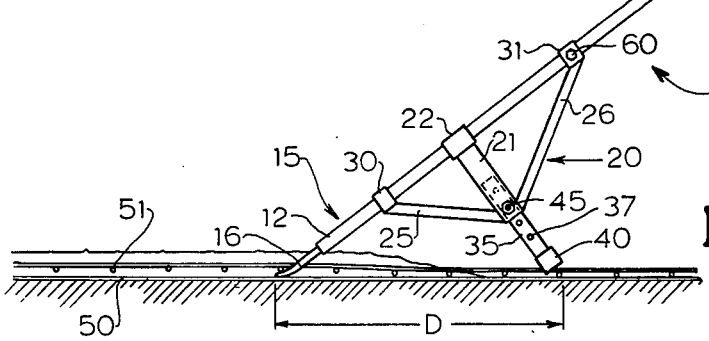
FIG. 2 is a side view of the tool of the invention and is depicted lifting a strand of mesh wire with the telescoping leg support in one position.
Figure 3:
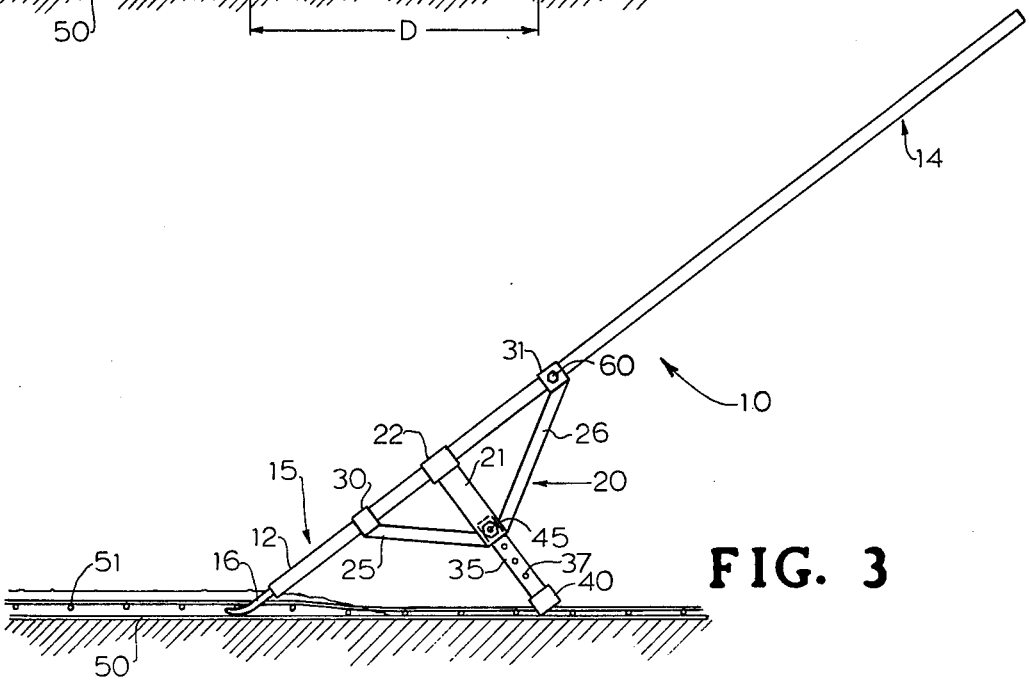
FIG. 3 is a view similar to FIG. 2 but showing the telescoping leg member in a more extended position.

The tool 10 of the invention comprises an elongated lever 12 formed of hollow metal tubing with an outer lever portion 14 and inner lift portion 15. A concave shaped solid metal point 16 is secured to the lift end 15 of the lever 12 and provides means for lifting a mesh wire strand as depicted in FIGS. 2 and 3.

Lever 12 is mounted on a lever support structure 20 comprising a central hollow metal tubular leg member 21 which extends outwardly below and in perpendicular relation to the longitudinal axis of lever 12. At the upper end of the central leg member 21 there is provided a hollow collar 22 which is integrally secured to central leg member 21 and slides on lever 12.

A pair of hollow tubular metal strut members 25, 26 are secured at their lower end in a rigid fixed relation to opposed lower surfaces of the central leg member 21 and extend outwardly and upwardly therefrom to respective collars 30, 31 which, as illustrated, are located on opposite sides of collar 22 and are of similar configuration. Collars 30 and 31 are rigidly secured to the respective strut members 25, 26.

An auxiliary hollow tubular metal leg member 35 slides within central leg member 21 in a telescoping relation and is provided with a plurality of apertures 37 in vertically spaced relation along the length of telescoping leg member 35. A hollow tubular metal ground support crossbar member 40 is secured to the lower end of telescoping member 35 in an inverted T configuration and its length L is selected so as to exceed the spacing between the mesh wires on which bar member 40 is designed to rest when making use of tool 10.

A nut and bolt arrangement 45 enables the relative positions of telescoping member 35 and central member 21 to be adjusted so as to vary the vertical height of the pivot point above the level of the mesh wire or ground level on which the tool is resting during use. A set screw arrangement 60 is provided on collar 31 so as to allow the lever support structure 20 to be locked in position on lever 12 so as to also be able to locate the pivot point at selected positions along the length of lever 12.

Two positions of the telescoping member 35 are illustrated by FIGS. 2 and 3. Thus, depending on the weight of mesh being lifted and the distance D which may be required in practice between the location of the cross bar member 40 and the point 16, the particular location of the pivot point at the intersection of central member 21 with lever 12 can be regulated, both along the length of the lever and also with respect to the distance of the pivot point from the mesh wire or ground on which the tool is being supported.

While applicant does not desire to be limited to any particular dimensions, in a specific example of the tool of the invention, the overall length was 84 inches, the height of the pivot point above ground level could be positioned within a range of 9½ to 13 inches and the length of the support bar on the telescoping leg member was seven inches. Also, in this same example, hollow metal tubing of square cross section was employed in the various members illustrated in the drawings. Such a tool was employed to lift a typical wire mesh such as wire mesh 50 illustrated in the drawings and was also found to be easily usable without puncturing the concrete mix support sheet such as the plastic sheet 51 also illustrated in the drawings.

What is claimed is:

1. A tool for levering concrete mesh wire, and the like, comprising:

(a) an elongated straight lever member formed of hollow metal tubing and having an outer lever end and an inner lift end, said lift end having rigidly secured thereto an outwardly extending concave metal point member adapted to engage strands of wire mesh and the like; and (b) a lever support structure slidably and adjustably mounting said lever member intermediate the said lever and lift ends thereof, said support structure comprising:

(i) a central hollow tubular metal leg member extending outwardly below and in perpendicular relation to the longitudinal axis of said lever member and having at the upper end of said leg member a collar integrally secured thereto and slidably fitted on said lever member;

(ii) a pair of hollow tubular metal strut members having lower ends rigidly fixed to opposed lower surfaces of said central leg member and extending outwardly and upwardly therefrom to respective collars secured thereto and slidably fitted on said lever member on opposite sides of said central leg member collar;

(iii) an auxiliary telescoping hollow tubular leg member slidably fitted within said central leg member and providing means for extending the length thereof, said auxiliary leg member having a hollow tubular metal ground support crossbar secured to the lower end thereof in an inverted T configuration and being of a length selected to span the mesh of reinforcement wire with which said tool is used;

(iv) locking means for locking said auxiliary leg member in a selected position on said central leg member to position the pivot point of said lever at a selected distance above the level of ground support; and (v) means on said pivotal support structure for locking such structure to said lever member to locate the position of said pivot point along the length of said lever.

* * * * *